US010238240B2

(12) United States Patent
Ciavarella

(10) Patent No.: US 10,238,240 B2
(45) Date of Patent: Mar. 26, 2019

(54) UPTAKE SHROUD FOR INVERTED PUMPS

(71) Applicant: GOJO Industries, Inc., Akron, OH (US)

(72) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/613,971

(22) Filed: Jun. 5, 2017

(65) Prior Publication Data

US 2017/0347842 A1 Dec. 7, 2017

Related U.S. Application Data

(60) Provisional application No. 62/346,603, filed on Jun. 7, 2016.

(51) Int. Cl.

| | |
|---|---|
| ***A47K 5/12*** | (2006.01) |
| ***B05B 11/00*** | (2006.01) |
| ***F04B 53/10*** | (2006.01) |
| ***F04B 7/04*** | (2006.01) |
| ***F04B 9/14*** | (2006.01) |
| ***F04B 13/00*** | (2006.01) |
| ***F04B 23/02*** | (2006.01) |
| ***F04B 53/06*** | (2006.01) |
| ***F04B 53/16*** | (2006.01) |

(52) U.S. Cl.

CPC ..... *A47K 5/1207* (2013.01); *B05B 11/0059* (2013.01); *B05B 11/3087* (2013.01); *F04B 7/04* (2013.01); *F04B 9/14* (2013.01); *F04B 13/00* (2013.01); *F04B 23/025* (2013.01); *F04B 53/06* (2013.01); *F04B 53/1002* (2013.01); *F04B 53/16* (2013.01)

(58) Field of Classification Search

CPC . A47K 5/1207; B05B 7/0018; B05B 11/0059; B05B 11/3087; F04B 7/04; F04B 53/1002

USPC ..... 222/183

See application file for complete search history.

(56) References Cited

U.S. PATENT DOCUMENTS

| | | | | |
|---|---|---|---|---|
| 5,799,841 | A * | 9/1998 | Wirt | A47K 5/1207 141/119 |
| 7,004,356 | B1 * | 2/2006 | Sayers | B05B 7/0037 222/137 |
| 7,011,237 | B1 * | 3/2006 | Sayers | B05B 11/0059 222/321.9 |
| 7,641,007 | B2 | 1/2010 | Radke et al. | |
| 8,591,207 | B2 * | 11/2013 | Ciavarella | F04B 53/1072 222/325 |
| 9,648,992 | B2 * | 5/2017 | Harris | B05B 11/0018 |
| 9,936,840 | B2 * | 4/2018 | Harris | A47K 5/1207 |

(Continued)

*Primary Examiner* — Benjamin R Shaw

(74) *Attorney, Agent, or Firm* — Calfee, Halter & Griswold LLP

(57) ABSTRACT

An exemplary refill unit for an dispenser includes a container for holding a liquid. The container has bottom side with a neck extending from the bottom side. A pump is connected to the neck of the container. The pump has a liquid pump portion that has a liquid pump inlet. The liquid pump inlet is located above the bottom of the container. A shroud is located over the liquid pump inlet and extends downward toward the bottom of the container. An air bleed valve is included and located in the top of the shroud.

19 Claims, 6 Drawing Sheets

(56) References Cited

U.S. PATENT DOCUMENTS

2005/0051579 A1* 3/2005 Kasting ..... B05B 11/0059
222/321.7
2005/0109798 A1* 5/2005 Kasting ..... B05B 11/0016
222/321.9
2005/0224519 A1* 10/2005 Law ..... B05B 7/0025
222/190
2006/0071033 A1* 4/2006 Lewis ..... A47K 5/12
222/321.9
2013/0037575 A1* 2/2013 van der Molen ..... B05B 1/3436
222/207
2014/0203047 A1* 7/2014 McNulty ..... B05B 7/0025
222/190
2015/0259188 A1* 9/2015 Smith ..... B67D 3/0061
222/478
2015/0266657 A1* 9/2015 Corney ..... B65D 47/06
222/478
2016/0221010 A1* 8/2016 Kurchev ..... B05B 7/02

* cited by examiner

UPTAKE SHROUD FOR INVERTED PUMPS

TECHNICAL FIELD

The present invention relates generally to fluid dispenser systems, such as liquid soap and sanitizer dispensers, and more particularly to an improved uptake shroud for inverted pumps.

BACKGROUND OF THE INVENTION

It is common in the dispensing arts to provide disposable units in which a pump is secured to a container that holds fluid that is to be dispensed. Actuating the pump causes the fluid to be dispensed from the container, and, when the container is empty of fluid (or the fluid level is below the pump intake), the unit can be disposed of and replaced with a new unit. While a multitude of fluids are dispensed in this manner, various fluids of particular interest in the present application include soaps, sanitizers, and lotions, though this invention is not to be limited to or by any particular fluid to be dispensed.

In some dispensing systems, the combination pump and container are received in a dispenser housing, which provides the actuating mechanisms necessary to actuate the pump and cause the dispensing of fluid to the individual operating the dispensing system. An exemplary dispenser and refill unit are shown in FIGS. 1 and 2. The dispenser 10 includes a dispenser housing 12 that is mounted to a wall and opens to receive a combination reciprocating piston pump 14 and container 16, the combination being herein referred to as a "refill unit," which is designated by the numeral 18. In the exemplary embodiment shown, a pushbar 20 of the dispenser housing 12 interacts with the reciprocating piston pump 14 of the refill unit 18 such that pushing on the pushbar 20 (typically when the cover 21 of the dispenser housing 20 is closed) causes the reciprocating piston pump 14 to be actuated to dispense fluid at the outlet of the dispenser 10. The dispenser housing and refill unit concept is all generally known and currently widely practiced in the dispensing arts, particularly for soaps, sanitizers and lotions and other personal care products.

A cross-section of a refill unit 18 is shown in FIG. 2. The reciprocating piston pump 14 fluidly communicates with a liquid S within the container 16 through inlet 22 of an axial extension 24 that extends adjacent a liquid inlet valve seat for liquid inlet valve 28. The foam pump of FIG. 2 is shown and described in U.S. Pat. No. 6,053,364, which is incorporated herein by reference in its entirety. The liquid inlet valve 28 defines in part a liquid chamber 26, the liquid chamber is defined by the volume within sidewall 50 between the inlet valve 28 and liquid outlet valve 30.

A liquid piston 32 reciprocates within the liquid chamber 26 and is biased by a spring 34 to a rest position, shown in FIG. 2, wherein the liquid chamber 26 has an expanded volume. The liquid piston 32 reciprocates back and forth to pump liquid. To dispense fluid, the liquid piston 32 is moved against the bias of the spring 34 (upwardly in the orientation of FIG. 2) to an actuated position in which the volume of the liquid chamber has been compressed. The change in volume increases the pressure within the liquid chamber 26, causing the inlet valve 28 to close off communication with the interior of the container 16 at inlet 22. The increase in pressure also causes the outlet valve 30 to open, and liquid S in liquid chamber 26 flows into mixing chamber 36. When the piston moves back downward to its rest position, the volume of liquid chamber 26 expands drawing liquid into liquid pump chamber 26 from container 16 through inlet 22.

Pump 14 includes an air chamber 38 and an air piston 40. The air piston 40 moves with the movement of the liquid piston 32 to compress the volume of the air chamber 38 which forces air from the air chamber 38 into the dispensing mixing chamber 36 where the air mixes with the liquid S to create a foam, which is dispensed out of outlet 48.

The reciprocating piston pump 14 is employed in an inverted position as shown in FIGS. 1 and 2, with the reciprocating piston pump 14 positioned partially in the neck 42 of the container 16 and held therein by an cap portion 45 threaded over the neck 42 of the container 16. The inlet 22 of the axial extension 24 extends well into the interior of the container 16, above an established floor of the container 16. As shown in FIG. 2, the reciprocating piston pump 14 might entirely fill in the neck 42, such that a floor 17 would be established at the bottom of the container 16, with the liquid S in the container 16 being able to reach that floor 17 in the inverted positioning of the container 16. Alternatively, as shown in FIG. 3, the reciprocating piston pump 14 may fit intimately in the neck 42 with its structure such that it provides a lowermost floor 29 (at the exterior sloped surface of the reciprocating piston pump 14) for the contents of the container 16. In such an instance, the pump itself would be considered as providing a floor for the liquid.

In the inverted positioning shown in FIG. 2, once the level of liquid in the container 16 falls below the inlet 22 of the axial extension 24, subsequent actuation of the reciprocating piston pump 14 will not draw liquid from the container and into the liquid chamber 26, and much of the contents of the refill unit 18 will be wasted (or at least be incapable of being dispensed by further actuation of the inverted reciprocating piston pump 14). Particularly, that volume of liquid S existing between the inlet 22 and the floor of the container 16, whether of a type like floor 17 or floor 29 described above, will not be capable of being dispensed by further actuation of the inverted reciprocating piston pump 14. This leads to a significant waste of liquid S.

This problem has been addressed in the prior art by providing either a curved dip tube 44 shown in FIG. 3 or an uptake shroud 46. In FIG. 3, a curved dip tube 44 fluidly communicates with inlet 22 and effectively provides the reciprocating piston pump 14 with an inlet 22*b* at a position much lower than that for inlet 22. Similarly, in FIG. 4, an uptake shroud 46 fluidly communicates with inlet 22 and effectively provides the reciprocating piston pump 14 with an inlet 22*c* at a position much lower than that for inlet 22. Although the intake of the valve has been lowered, a problem occurs when the refill unit begins to empty air sometimes travels up the intake shroud or extension pipe and causes inconsistent outputs. These exemplary prior art embodiments are shown and described in U.S. Pat. No. 7,641,077 titled Pump Dispensers and U.S. Pat. No. 8,591,207 titled Pump With Side Inlet Valve For Improved Functioning In An Inverted Container. Both of which are incorporated herein by reference in their entirety.

SUMMARY

Exemplary embodiments of dispenser systems, refill units, and apparatuses are disclosed herein. An exemplary refill unit for a dispenser includes a container for holding a liquid and a pump connected to the bottom of the container. The pump includes a liquid pump portion. The liquid pump portion has liquid pump inlet. A housing surrounds the liquid pump inlet and an air bleed valve located in the housing.

Another exemplary refill unit for an dispenser includes a container for holding a liquid. The container has bottom side with a neck extending from the bottom side. A pump is connected to the neck of the container. The pump has a liquid pump portion that has a liquid pump inlet. The liquid pump inlet is located above the bottom of the container. A shroud is located over the liquid pump inlet and extends downward toward the bottom of the container. An air bleed valve is included and located in the top of the shroud.

An exemplary apparatus for fluid dispensing includes a shroud configured to fit over a pump inlet wherein the shroud extends downward from the pump inlet when the pump is in an inverted position such that the pump inlet is above the pump outlet and an air bleed valve located on the shroud. The air bleed valve is configured to allow air located within the shroud to pass upward past the air bleed valve. In some embodiments, the exemplary apparatus includes a pump connected to a container and the shroud. In some embodiments, the apparatus includes a dispenser.

BRIEF DESCRIPTION OF THE DRAWINGS

These and other features and advantages of the present invention will become better understood with regard to the following description and accompanying drawings in which.

DETAILED DESCRIPTION

Pumps, whether liquid or foam pumps are known and though a specific embodiment showing specific chamber structures, piston structures and outlet valve structures is disclosed, this invention is not limited to or by any specific structure for the known elements. For example, even though a piston pump is shown for the liquid pump, other pumps can be and are employed in structures that may be used in combination with the present invention. Accordingly, the present invention is not limited to or by any particular valve or piston structure. Embodiments of this invention disclosed herein improve the liquid inlet for liquid pumps and foam pumps used in an inverted position.

Figure 5:
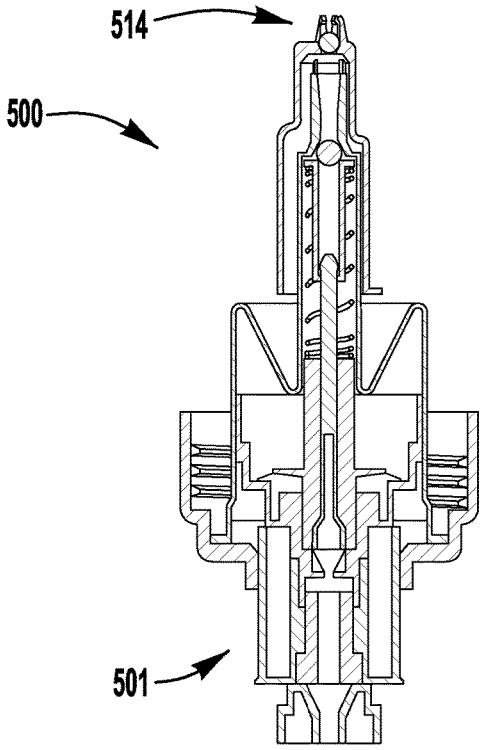
FIG. 5 is a cross-sectional view of exemplary embodiment of an improved uptake shroud on an inverted pump.
Figure 6:
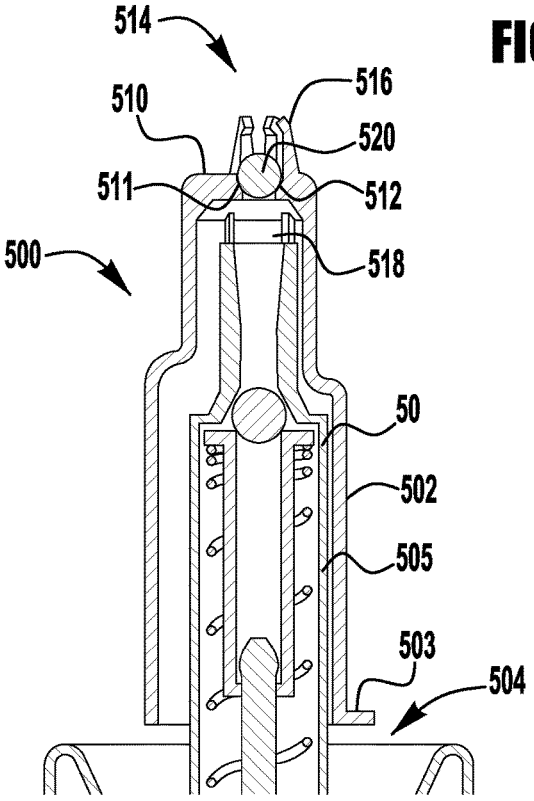
FIG. 6 is an enlarged cross-sectional partial view of the exemplary embodiment of an improved uptake shroud on an inverted pump with an air bleed valve in a closed position.
Figure 7:
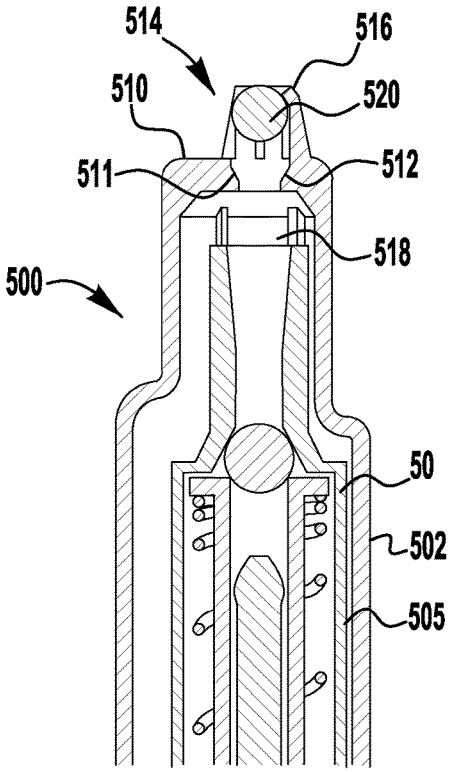
FIG. 7 is an enlarged cross-sectional partial view of the exemplary embodiment of an improved uptake shroud on an inverted pump with an air bleed valve in an open position.

FIGS. 5 through 7 illustrates an exemplary embodiment of an inventive uptake shroud 500 on a foam pump 501. Uptake shroud 500 includes a housing 502 that extends downward, fits over, and is secured to the pump body 50. In this exemplary embodiment, uptake shroud 500 includes a lower flange 503 at the bottom of housing 502 which forms a portion of intake 504. A passage 505 is formed between an inside surface of housing 502 and an outside of pump body 50. Passage 505 allows fluid to flow from the level of the lower flange 503 up to pump intake opening 518.

Uptake shroud 500 includes a top portion 510. In addition, uptake shroud 500 includes an air bleed valve 514. Top portion 510 has an aperture 511 and a valve seat 512 is located around aperture 511. In this exemplary embodiment, air bleed valve 514 is a ball valve, with a ball 520 that seats in valve seat 512 to prevent fluid flow. Ball 520 may be made of any material. In an exemplary embodiment, ball 520 is a floating ball, such as a hollow plastic ball, that floats in the liquid when the liquid is above the top 510. Ball 520 is retained by cage 516, which is formed of three projections 516. In some embodiments, there are more than tree projections During the priming stroke, i.e. when liquid is being drawn up the interior of the uptake shroud 500 and into the liquid pump portion, ball 520 may seal against seat 512 to prevent fluid flow through aperture 511. In some embodiments, when the liquid level is above the top of ball 520, ball 520 floats and liquid may flow into the uptake shroud 500 through aperture 511, however, at least when the liquid level is below ball 520, ball 520 seals against seat 512, and causes the liquid to be drawn in from intake 504 below flange 503.

After completing the priming strokes, any air that has entered uptake shroud 500 may escape up through aperture 511 past ball 520. If ball 520 is a floating ball and the liquid level is above the ball 520, the air simply flows past. In addition, in some embodiments, ball 520 shuttles up and down during operation of the pump. It is believed that the shuttling of ball 520 causes trapped air bubbles to break down and allow the air to escape through air bleed valve 514. Experimental results have demonstrated that the inventive uptake shroud 500 resulted in reducing output inconsistencies as the level of fluid in the container dropped.

Although the exemplary embodiment shows and describes air bleed valve 514 as a ball valve, other types of valves, such as, for example, mushroom valves, flapper valves, and the like may be used provided they allow air to escape from the uptake shroud and maintain the integrity of the uptake shroud when the liquid level is below the top of the pump intake 518.

In addition, uptake shroud 500 need not take the illustrated form. Uptake shroud 500 may take many forms. In some embodiments, uptake shroud 500 only partially surrounds the pump body 50.

Figure 1:
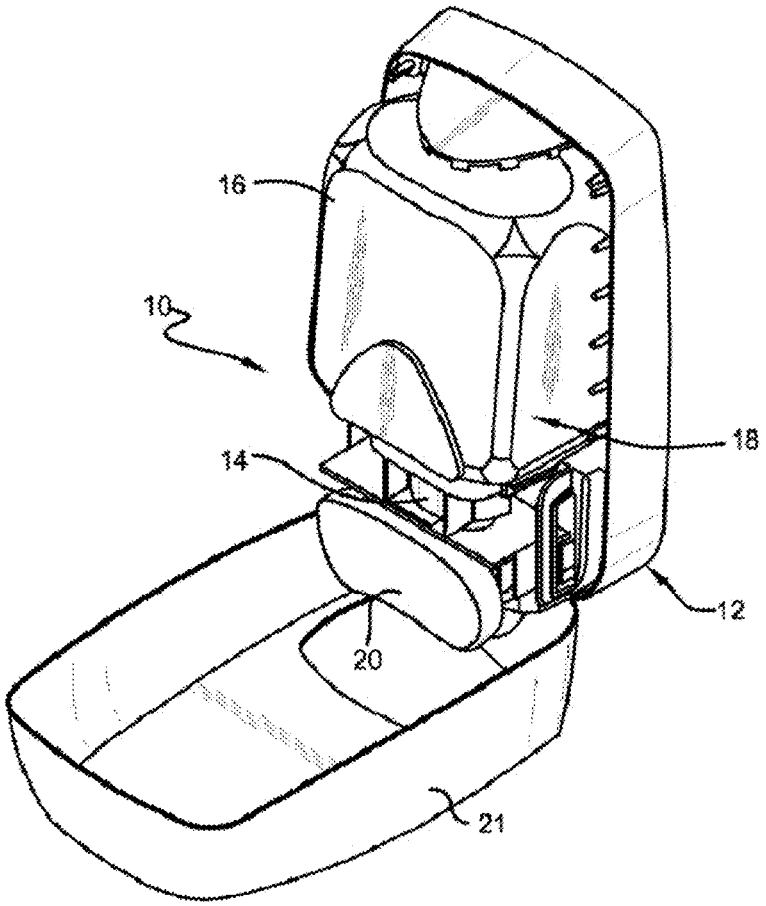
FIG. 1 (Prior Art)
FIG. 1 is a perspective view of a prior art dispensing system showing a dispenser housing that receives a combination pump and container (the combination also be referred to as a refill unit) in an inverted position.
Figure 2:
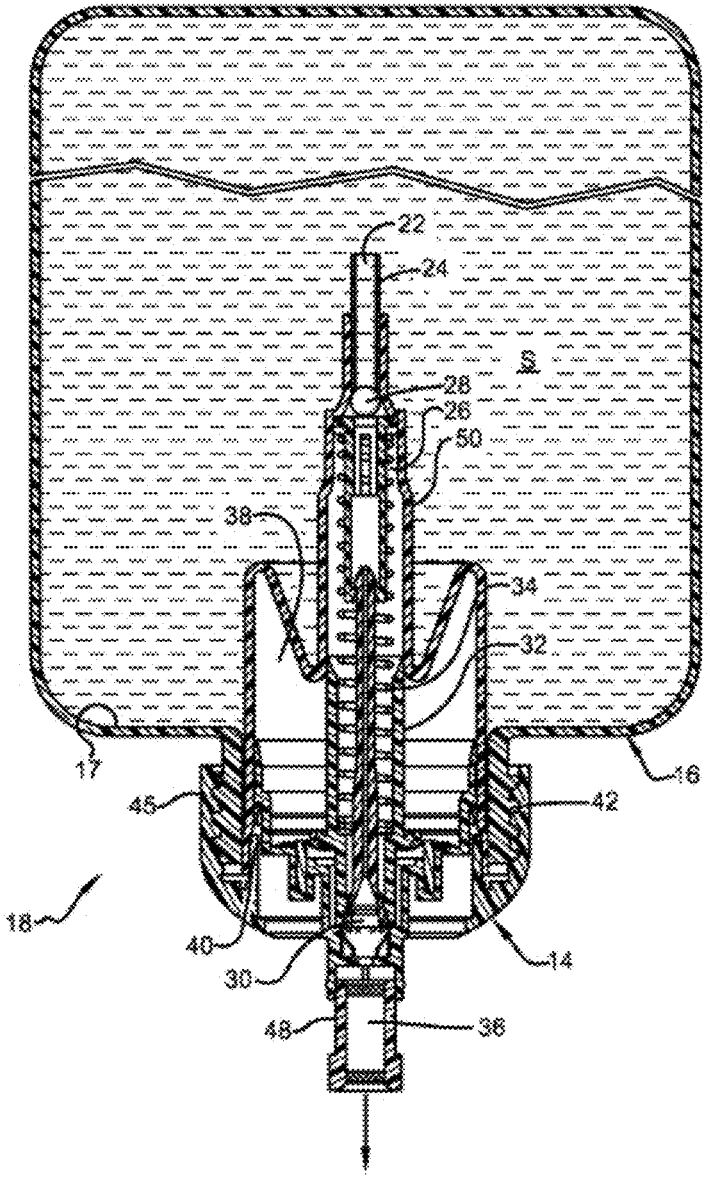
FIG. 2 (Prior Art)
FIG. 2 is a cross-sectional view of a refill unit of the prior art, shown without any structures serving to better dispenser the contents of the container.
Figure 3:
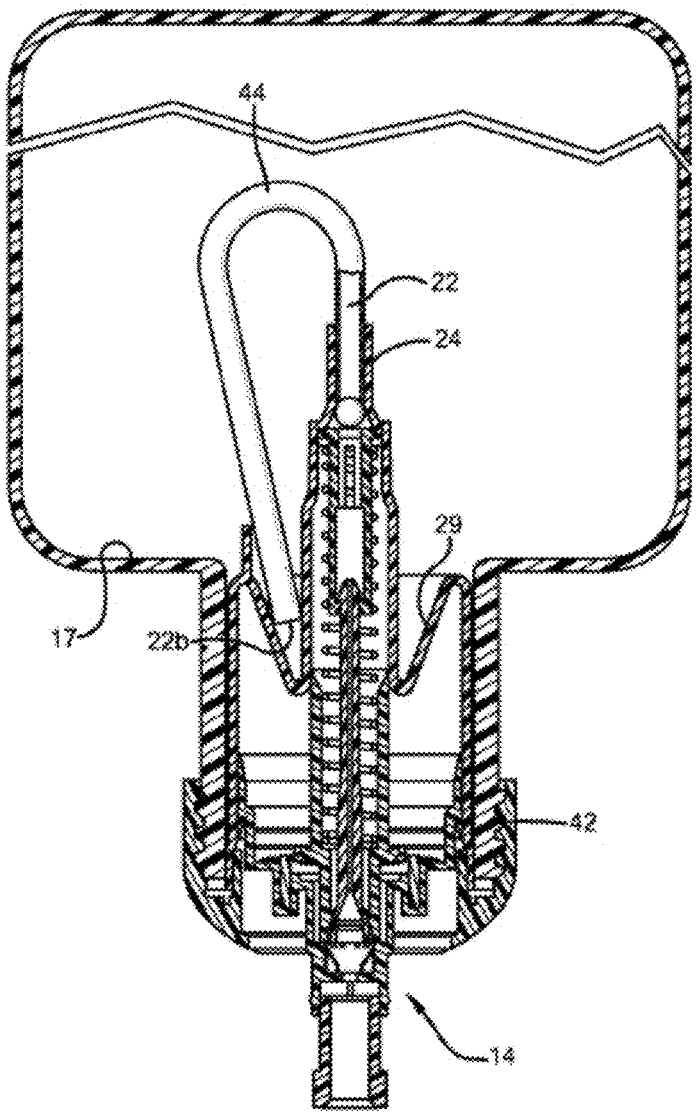
FIG. 3 (Prior Art)
FIG. 3 is a cross-sectional view of a refill unit of the prior art, shown with a curved dip tube structure serving to better dispenser the contents of the container.
Figure 4:
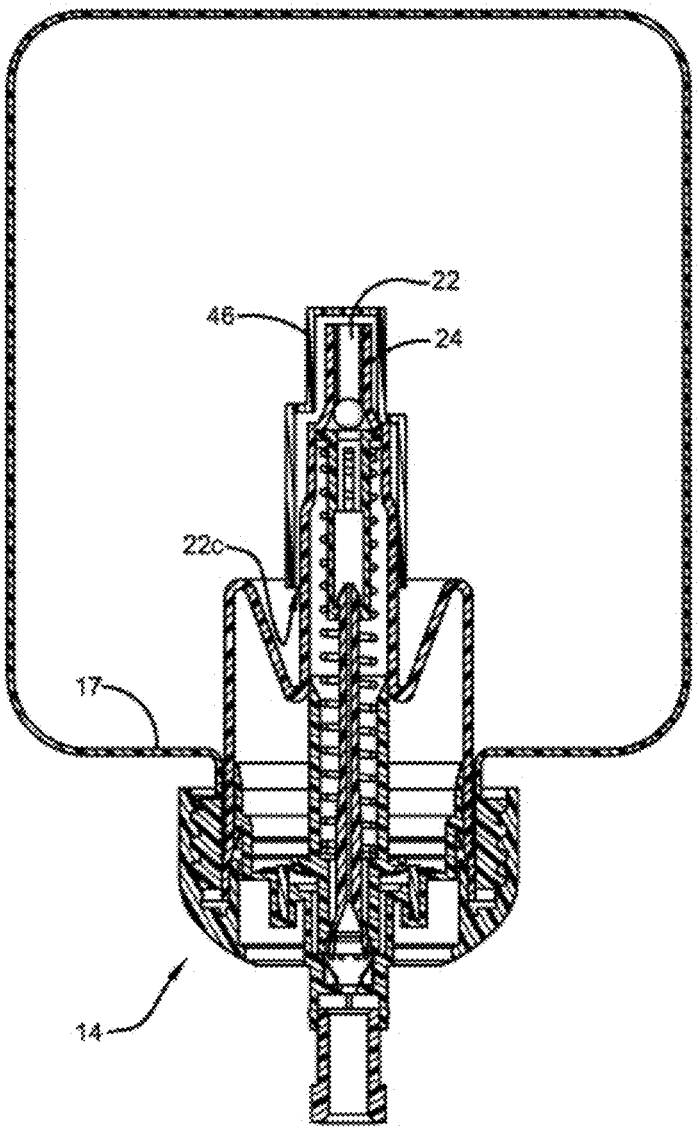
FIG. 4 (Prior Art)
FIG. 4 is a cross-sectional view of a refill unit of the prior art, shown with an uptake shroud structure serving to better dispenser the contents of the container.

Additional embodiments include a tube (not shown) similar to the prior art tube 44 of FIG. 3 may be used provided that an air bleed valve is located near highest portion of the tube (not shown) or pump fluid inlet.

Figure 8:
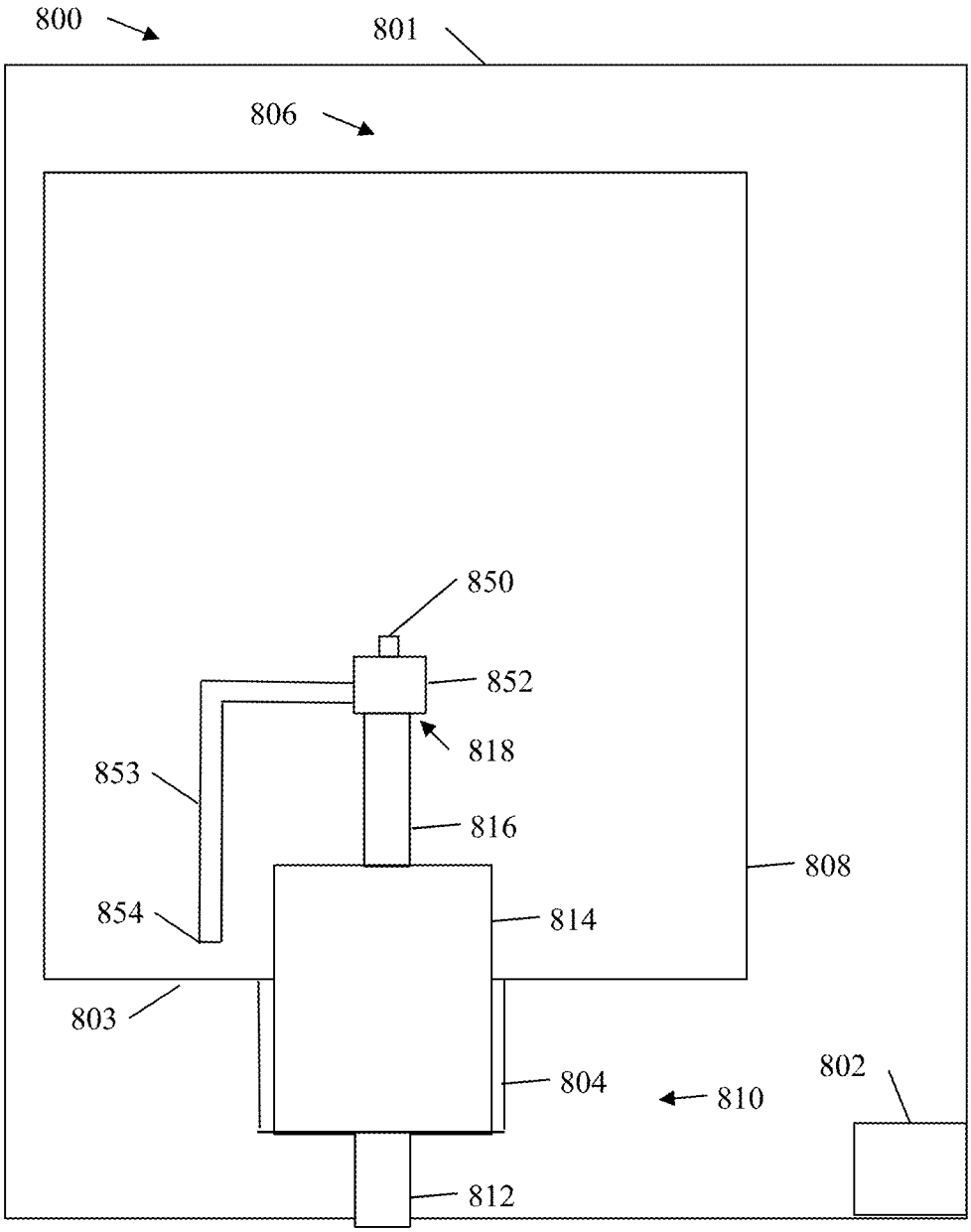
FIG. 8 is a schematic view of an exemplary embodiment of a refill unit with a inverted pump and an improved uptake shroud.

FIG. 8 is a schematic view of an exemplary embodiment of a dispenser 800. In this exemplary embodiment dispenser 800 is a touch-free, or automatic, dispenser, however it could be a manual dispenser. Dispenser 800 includes a housing 801 and associated circuitry 802. A refill unit 806 is installed in dispenser 800. Refill unit 806 includes a container 808 and a pump 810. Pump 810 is a foam pump, however pump 810 could be a liquid pump. Pump 810 includes an outlet 812, an air pump portion 814 and a liquid pump portion 816. Liquid pump portion 816 includes a liquid inlet 818. Secured to liquid inlet 818 is a housing 852 with an air bleed valve 850. Extending from housing 852 is a conduit 853 that extends down to a liquid inlet 854 located near the bottom 803 of container 802.

Air bleed valve 850 is configured to seat when the foam pump 810 draws in liquid from the container due to vacuum pressure created in housing 852 and conduit 853 while the liquid pump portion 816 is priming. In some embodiments, when the vacuum pressure is removed, air bleed valve 850 cracks open allowing any air in the housing or conduit 853 to escape through air bleed valve 850. In some embodiments, absent a vacuum pressure in housing 852 or conduit 853, air bleed valve 850 only partially seats, which allows air to flow past the air bleed valve 850 into the container. In some embodiments, air bleed valve 850 includes a floating valve, such as, for example, a floating ball, and the floating valve floats when liquid is above the top of air bleed valve 850.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

What is claimed is:

1. A refill unit for a dispenser comprising:
a container for holding a liquid;
a pump connected to the bottom of the container;
the pump having a liquid pump portion;
the liquid pump portion having a liquid pump inlet;
a housing at least partially surrounding the liquid pump inlet;
an air bleed valve located in the housing; and
wherein the housing is secured to the pump and a conduit extends from the housing to a lower point in the container.

2. The refill unit of claim 1 wherein the housing at least partially surrounds the liquid pump portion and extends downward forming an opening between the housing and the liquid pump portion.

3. The refill unit of claim 1 wherein the air bleed valve comprises a ball valve.

4. The refill unit of claim 3 wherein the ball valve has a floating ball.

5. The refill unit of claim 4 further comprising a cage for retaining the ball.

6. A refill unit for an dispenser comprising:
a container for holding a liquid;
the container having bottom side;
the container having a neck extending from the bottom side;
a pump connected to the neck of the container;
the pump having a liquid pump portion;
the liquid pump portion having a liquid pump inlet;
wherein the liquid pump inlet is above the bottom of the container;
a shroud located over the liquid pump inlet and extending downward toward the bottom of the container; and
an air bleed valve located proximate the top of the shroud.

7. The refill unit of claim 6 wherein the air bleed valve comprises a ball valve.

8. The refill unit of claim 7 wherein the ball valve has a floating ball.

9. The refill unit of claim 8 further comprising a cage for retaining the floating ball.

10. The refill unit of claim 6 wherein the pump comprises an air pump portion.

11. An apparatus for fluid dispensing comprising:
a shroud configured to fit over a pump inlet wherein the shroud extends downward from the pump inlet when the pump is in an inverted position such that the pump inlet is above the pump outlet; and
an air bleed valve located on the shroud,
wherein the air bleed valve is configured to allow air located within the shroud to pass upward past the air bleed valve.

12. The apparatus for fluid dispensing of claim 11 wherein the air bleed valve comprises a ball valve.

13. The apparatus for fluid dispensing of claim 12 wherein the ball valve comprises a floating ball.

14. The apparatus for fluid dispensing of claim 12 further comprising a cage for retaining a ball of the ball valve in a selected area.

15. The apparatus for fluid dispensing of claim 11 further comprising:
a container of fluid and a pump;
the pump having a pump inlet;
wherein the shroud is located over the pump inlet an extends downward creating a fluid inlet that is located below the pump inlet.

16. The apparatus for fluid dispensing of claim 15 further comprising a housing for holding the container and pump.

17. The apparatus for fluid dispensing of claim 16 wherein the housing includes an actuator for causing the pump to dispense fluid.

18. The apparatus for fluid dispensing of claim 17 wherein the actuator is a manual actuator.

19. The apparatus for fluid dispensing of claim 17 wherein the actuator is an automatic actuator.

* * * * *